US009700132B2

(12) United States Patent
Webster et al.

(10) Patent No.: US 9,700,132 B2
(45) Date of Patent: Jul. 11, 2017

(54) BRUSH CLEANING SYSTEM

(71) Applicant: Hamilton Webster LLC, Ferndale, MI (US)

(72) Inventors: Sarah A. Webster, Ferndale, MI (US); Justin Aiello, Kennebunk, ME (US)

(73) Assignee: Hamilton Webster LLC, Ferndale, MI (US)

( * ) Notice: Subject to any disclaimer, the term of this patent is extended or adjusted under 35 U.S.C. 154(b) by 391 days.

(21) Appl. No.: 14/268,039

(22) Filed: May 2, 2014

(65) Prior Publication Data

US 2015/0013726 A1 Jan. 15, 2015

Related U.S. Application Data

(60) Provisional application No. 61/844,576, filed on Jul. 10, 2013, provisional application No. 61/844,408, filed on Jul. 9, 2013.

(51) Int. Cl.
*A46B 17/06* (2006.01)

(52) U.S. Cl.
CPC ..... *A46B 17/06* (2013.01)

(58) Field of Classification Search
CPC ..... B44D 3/006; B44D 3/125; B44D 3/00; A46B 17/06
USPC ..... 15/215, 218.1, 218, 257.01, 142; 206/209, 361–362, 15.2; 12/215, 218.1, 12/218, 257.01, 142
See application file for complete search history.

(56) References Cited

U.S. PATENT DOCUMENTS 5,687,444 A * 11/1997 Hakker ..... A46B 17/06 15/104.92
6,050,408 A * 4/2000 Testa ..... A46B 17/04 206/15.2
6,202,837 B1 * 3/2001 Mason ..... B44D 3/123 206/1.7
7,748,524 B2 * 7/2010 Ruzumna ..... A46B 17/06 134/201

FOREIGN PATENT DOCUMENTS

EP 1025777 A2 * 8/2000 ..... A46B 17/06

* cited by examiner

*Primary Examiner* — Laura C Guidotti
(74) *Attorney, Agent, or Firm* — Carlson, Gaskey & Olds, P.C.

(57) ABSTRACT

A brush cleaning system includes a container having a bottom portion and an opening. A plurality of projections are located proximate to the bottom portion of the container. Bristles of a brush engage the plurality of projections to splay the bristles of the brush. A cap seals the opening of the container. A liquid solution is added to the container to clean the brush.

15 Claims, 7 Drawing Sheets

BRUSH CLEANING SYSTEM

REFERENCE TO RELATED APPLICATION

This application claims priority to U.S. Provisional Patent Application No. 61/844,576 filed Jul. 10, 2013 and U.S. Provisional Patent Application No. 61/844,408 filed Jul. 9, 2013.

BACKGROUND OF THE INVENTION

Cosmetic brushes, paint brushes and other brushes need to be cleaned to remove excess makeup, oil, and other contaminants. Cosmetic brushes, in particular, are commonly cleaned individually. This can be done in a variety of ways. This includes spraying a cleaning solution onto a fabric and then dragging the bristles of the brush forward and backward over the wet fabric until the bristles of the brush are clean. Or, brushes can be hand-washed individually with soap products under a running faucet. In either case, washing brushes individually can be time consuming and messy.

SUMMARY OF THE INVENTION

A brush cleaning system according to an exemplary embodiment of this disclosure, among other possible things, includes a container having a bottom portion and an opening. A plurality of projections are located proximate to the bottom portion of the container. Bristles of a brush engage the plurality of projections to splay the bristles of the brush. A liquid solution is added to the container to clean the brush. A cap seals the opening of the container.

In a further embodiment of any of the foregoing brush cleaning systems, the opening is an upper end opening, and the cap is an upper end cap.

In a further embodiment of any of the foregoing brush cleaning systems, the opening is a lower end opening, the cap is a lower end cap, and the lower end cap seals the lower end opening of the container.

In a further embodiment of any of the foregoing brush cleaning systems, the lower cap includes an inner surface having a plurality of parallel ribs and a plurality of spaces. One of the plurality of spaces is located between two adjacent of the plurality of parallel ribs.

In a further embodiment of any of the foregoing brush cleaning systems, the opening is an upper end opening and the cap is an upper end cap, the brush cleaning system further includes a lower end opening and a lower end cap, and the lower end cap seals the lower end opening of the container.

In a further embodiment of any of the foregoing brush cleaning systems, the container includes a fill line to indicate a quantity of the liquid solution added to the container.

In a further embodiment of any of the foregoing brush cleaning systems, a jar mat includes the plurality of projections. The jar mat includes a base and the plurality of projections project upwardly from the base.

In a further embodiment of any of the foregoing brush cleaning systems, the plurality of projections include a first set of projections and a second set of projections, the first set of projections are taller than the second set of projections, and one of the first set of projections and one of the second set of projections alternate.

In a further embodiment of any of the foregoing brush cleaning systems, the lower cap includes an inner surface having a plurality of parallel ribs and a plurality of spaces. One of the plurality of spaces is located between two adjacent of the plurality of parallel ribs. The plurality of projections are located in the plurality of spaces of the lower cap when in a storage position, and the jar mat can be rotated 180° such that the plurality of projections are extending towards an upper opening of the container when in a use position.

In a further embodiment of any of the foregoing brush cleaning systems, a graduated drying mat includes a base and a plurality of projections extending upwardly from the base. The plurality of projections have different heights to define a graduated surface, and the brush is placed on the drying mat to dry the brush.

In a further embodiment of any of the foregoing brush cleaning systems, the bristles are splayed in a controlled manner.

A brush cleaning system according to an exemplary embodiment of this disclosure, among other possible things, includes a container having a lower opening, an upper opening and a bottom portion. A jar mat includes a base and a plurality of projections that project upwardly from the base towards the upper opening. Bristles of a brush engage the plurality of projections to splay the bristles of the brush in a controller manner. A lower cap seals the lower opening of the container. The lower cap includes an inner surface having a plurality of parallel ribs and a plurality of spaces. One of the plurality of spaces is located between two adjacent of the plurality of parallel ribs. An upper cap that seals the upper opening of the container. A liquid solution is added to the container to clean the brush.

In a further embodiment of any of the foregoing brush cleaning systems, the container includes a fill line to indicate a quantity of the liquid solution added to the container.

In a further embodiment of any of the foregoing brush cleaning systems, the plurality of projections include a first set of projections and a second set of projections. The first set of projections are taller than the second set of projections, and the first set of projections and second set of projections alternate.

In a further embodiment of any of the foregoing brush cleaning systems, a graduated drying mat includes a base and a plurality of projections extending upwardly from the base. The plurality of projections has different heights to define a graduated surface, and the brush is placed on the drying mat to dry the brush.

A method of cleaning a brush according to an exemplary embodiment of this disclosure, among other possible things, includes adding a liquid cleaning solution to a container, placing at least one brush inside the container, sealing the container, hand shaking the container to clean the bristles of at least one brush, and engaging bristles of the brush with projections proximate a to bottom of the container to splay the bristles of the brush during the step of hand shaking.

In a further embodiment of any of the foregoing methods, includes the step of pouring the liquid solution from the container after the step of hand shaking.

In a further embodiment of any of the foregoing methods, includes the steps of adding water to the container and re-hand shaking the container after the step of pouring the liquid.

In a further embodiment of any of the foregoing methods, includes the steps of removing the brush from the container and placing the brush on a graduated mat after the step of hand shaking the container.

In a further embodiment of any of the foregoing methods, the step of engaging the bristles splays the bristles in a controlled manner.

The brush cleaning system allows one or more brushes to be cleaned quickly and effectively in an enclosed container that is hand shaken with a brush or brushes inside, along with a cleaning solution. During this shake-cleaning process, protrusions in the jar mat at the bottom of the container engage the bristles of the brush to enhance cleaning and control splaying. The design of the system also allows a brush to be individually hand cleaned, if desired, by removing the twist-off bottom and rubbing and/or swirling the brush along the protrusions of the jar mat. The system also includes a graduated drying mat that encourages water to be drained away from the handle of the brush and also allows air to circulate around the entire elevated brush head.

DETAILED DESCRIPTION OF THE PREFERRED EMBODIMENT

Figure 1:
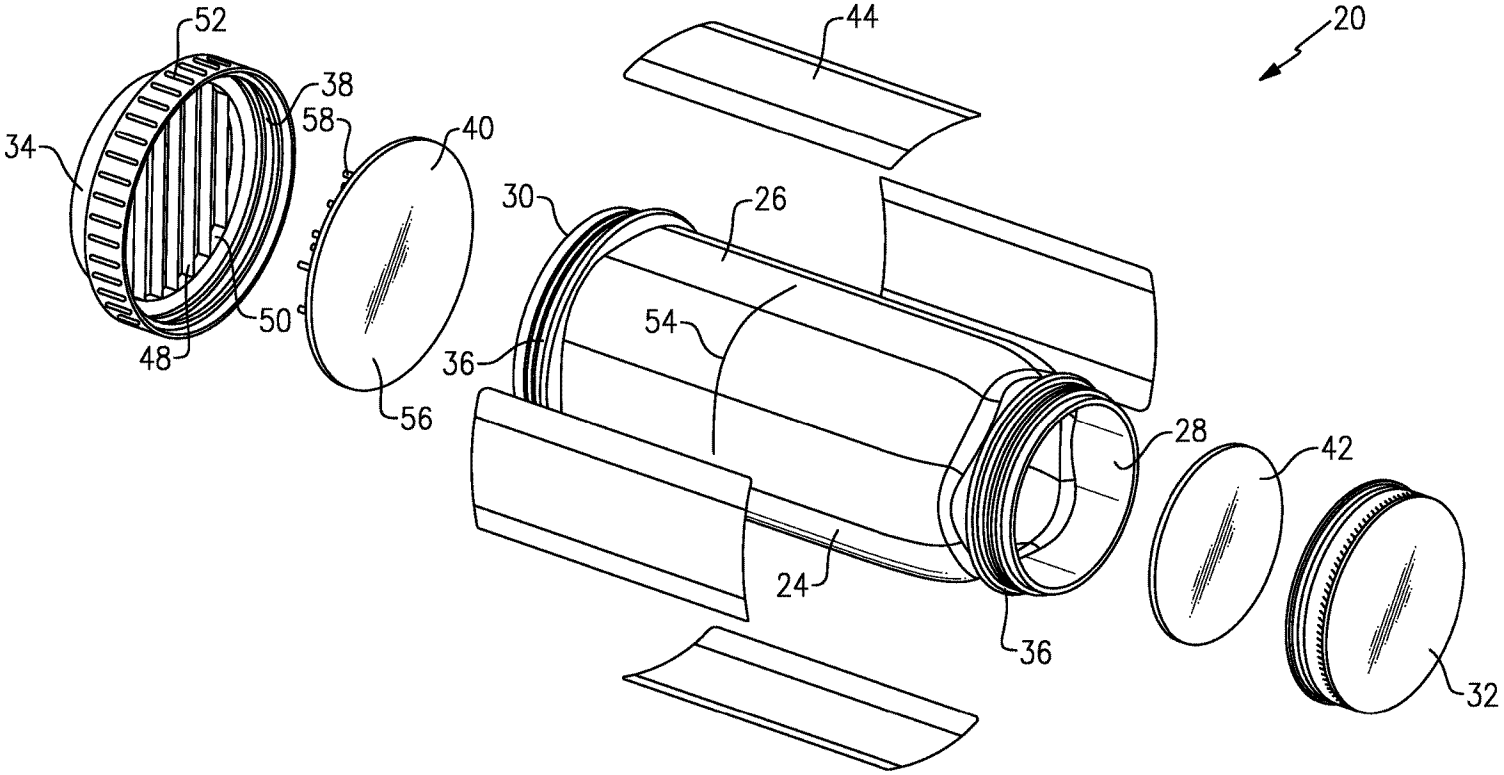
FIG. 1 illustrates an exploded perspective view of a brush cleaning system.

FIG. 1 illustrates a brush cleaning system 20 employed to clean a brush 22 (shown in FIGS. 8, 9 and 10) or a multitude of brushes 22. Although a makeup brush is illustrated and described, the brush 22 can be any type of brush, including a paint brush, etc.

The brush cleaning system 20 includes a container 24 having a body portion 26, an open upper end 28 and an open lower end 30. An upper cap 32 is attached to the upper end 28, and a lower cap 34 is attached to the lower end 30. The caps 32 and 34 seal the container 24 and prevent leaks of fluid. The caps 32 and 34 can be secured to the container 24 in any manner. In one example, the caps 32 and 34 are threaded onto the container 24. In this example, an external surface of the upper end 28 and the lower end 30 of the container 24 includes a plurality of threads 36 and an internal surface of the upper cap 32 and lower cap 34 includes a plurality of threads 38 that engage the plurality of threads 36. The brush cleaning system 20 also includes a jar mat 40 and a lid gasket 42 located adjacent the lower cap 34 and the upper cap 32, respectively. The container 24 also includes a fill line 54 that indicates the amount of cleaning solution that should be added to the container 24. At least one label 44 can be added to an exterior surface of the container 24. In one example, the container 24 is made of acrylic.

An inner surface of the lower cap 34 includes a plurality of ribs 48 and a space 50 between each pair of adjacent ribs 48. In one example, the plurality of ribs 48 are substantially parallel. An external circumferential surface of the lower cap 34 includes gripping ribs 52 to assist in turning the lower cap 34.

Figure 2:
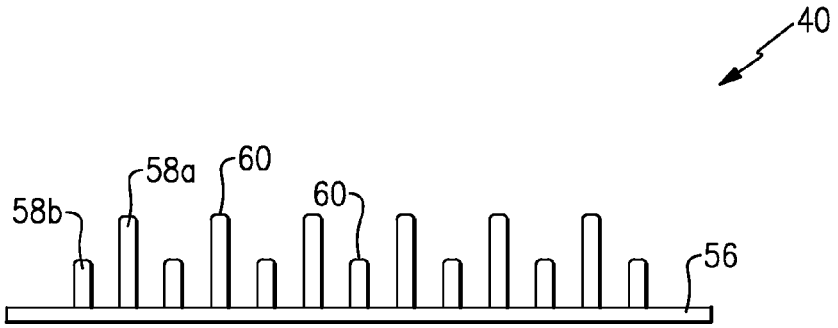
FIG. 2 illustrates a side view of a jar mat.
Figure 3:
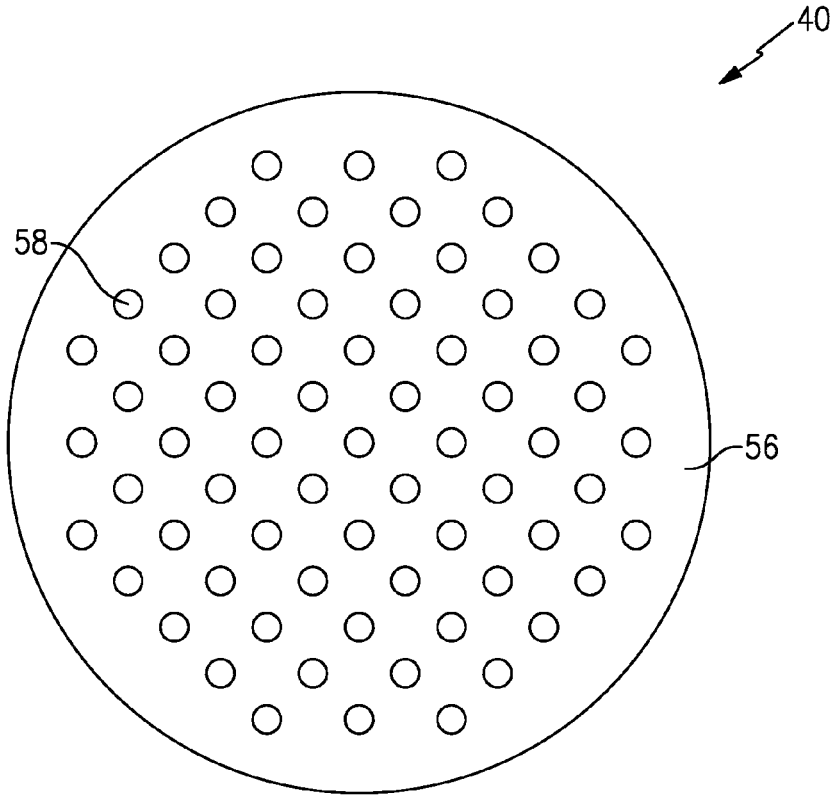
FIG. 3 illustrates a top view of the jar mat.

As shown in FIGS. 2 and 3, the jar mat 40 includes a base 56 and a plurality of projections 58 extending upwardly from the base 56. The shape of the base 56 corresponds to the shape of the lower cap 34. In one example, the base 56 is substantially circular. The projections 58 include first projections 58*a* and second projections 58*b* in an alternating configuration. The first projections 58*a* are taller than the second projections 58*b*. The projections 58 each have a rounded tip 60. The projections 58*a* and 58*b* act as an agitator relative to bristles 64 of a brush 22 placed in the container 24 during cleaning, as explained below. In one example, the jar mat 40 is made of a soft and flexible material, such as TPR SHORE A50 (a thermoplastic rubber having a hardness level of SHORE A50). In one example, the jar mat 40 is made of rubber and/or plastic.

Figure 4:
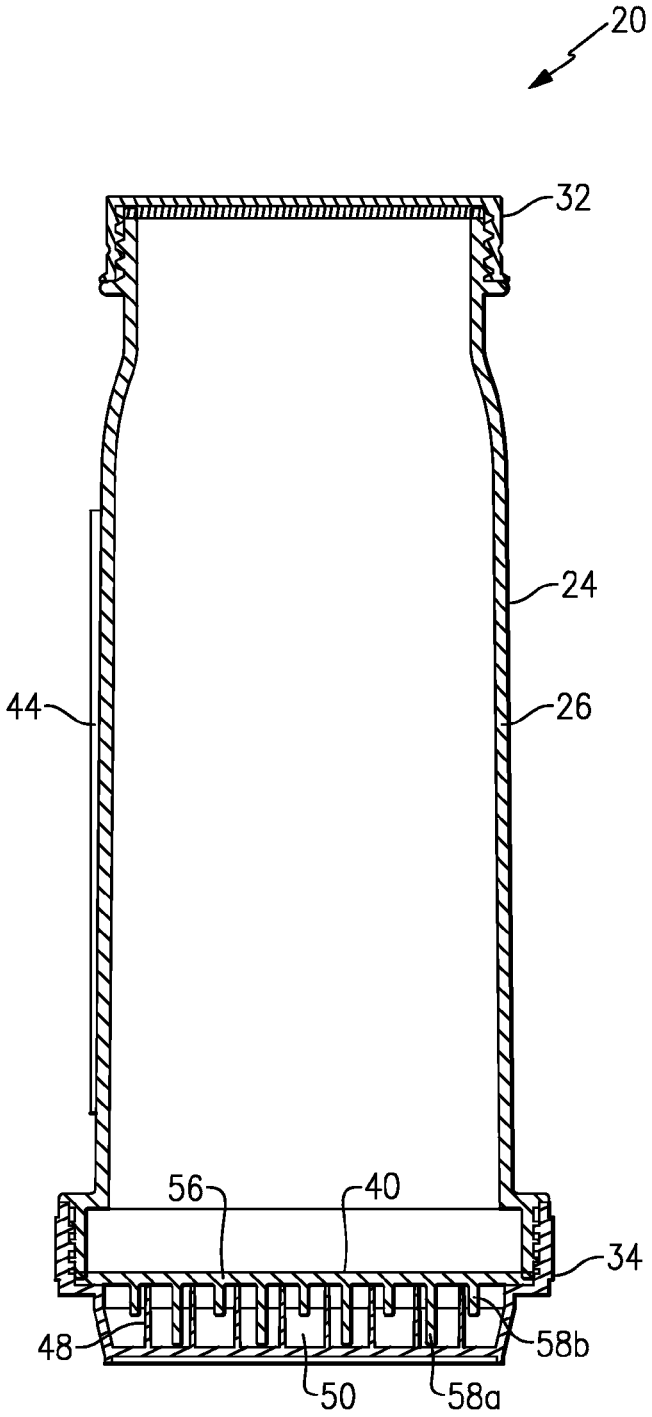
FIG. 4 illustrates a side view of the brush cleaning system in a storage position.

FIG. 4 illustrates the brush cleaning system 20 in a storage position. The projections 58*a* and 58*b* of the jar mat 40 are received in the spaces 50 between the ribs 48 of the lower cap 34, and the lower cap 34 is secured to the lower end 30 of the container 24. The upper cap 32 is secured to the upper end 28 of the container 24.

Figure 5:
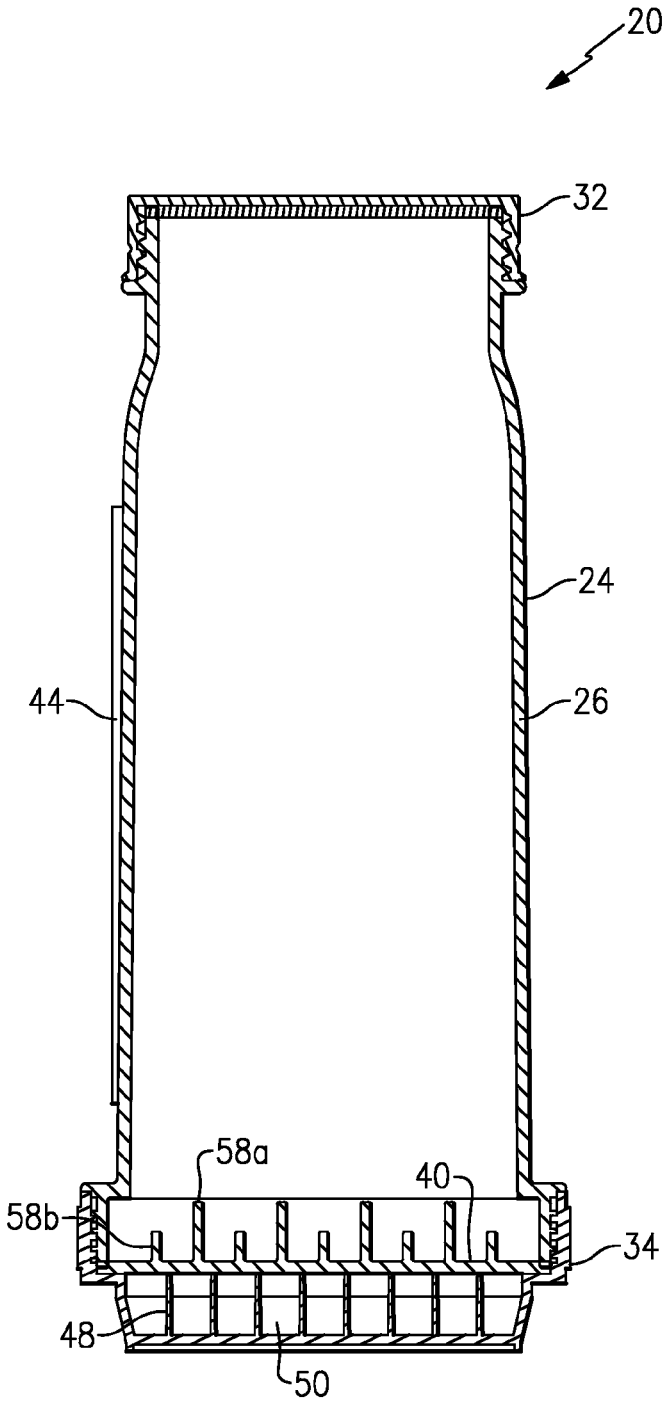
FIG. 5 illustrates a side view of the brush cleaning system in a use position.

FIG. 5 shows the brush cleaning system 20 in the use position. The lower cap 34 is removed from the container 24, and the jar mat 40 is rotated approximately 180° such that an underside of the jar mat 40 contacts an upper surface of the ribs 48 of the lower cap 34. In this position, the projections 58 extend upwardly towards the upper cap 32.

Figure 6:
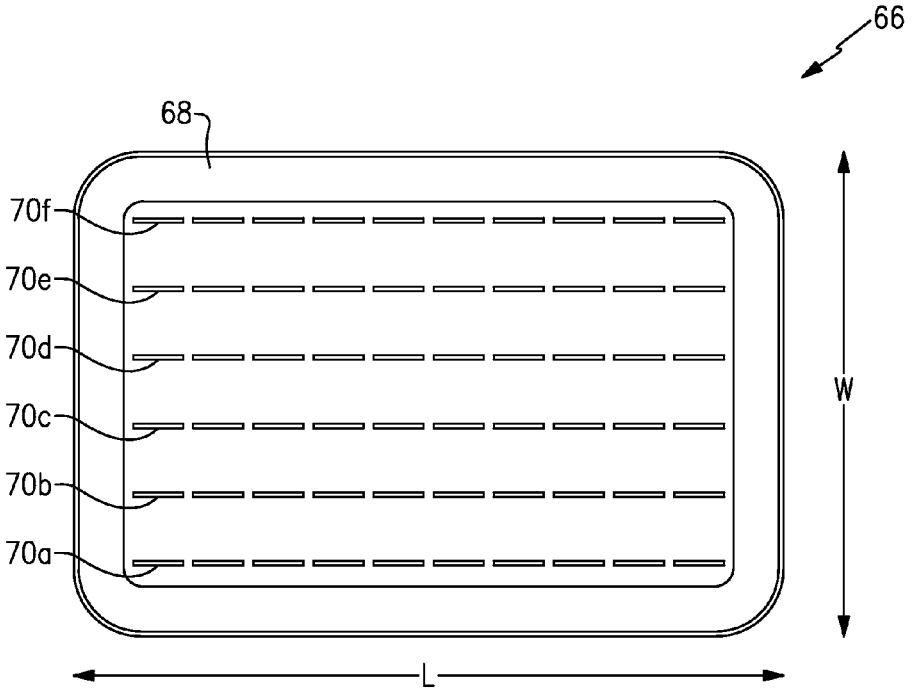
FIG. 6 illustrates a top view of a drying mat.
Figure 7:
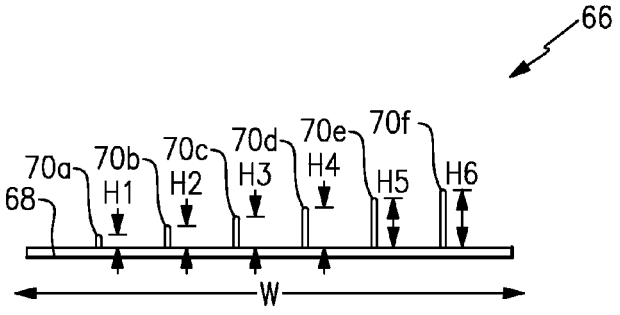
FIG. 7 illustrates a side view of the drying mat.

As shown in FIGS. 6 and 7, the brush cleaning system 20 also includes a drying mat 66 that is separate from the container 24. In one example, the drying mat 66 is flexible. The drying mat 66 includes a base 68 that is substantially rectangular in shape having a length L and a width W. The drying mat 66 includes a plurality of projections 70 that extend upwardly from the base 68 of the drying mat 66. In one example, the drying mat 66 is made of a soft and flexible material, such as TPR SHORE A50 (a thermoplastic rubber having a hardness level of SHORE A50). In one example, the drying mat 66 is made of rubber and/or plastic.

In one example, the projections 70 have different heights H. A first row of projections 70*a* relative to the width W have a height of H1, a second row of projections 70*b* have a height of H2, a third row of projections 70*c* have a height of H3, a fourth row of projections 70*d* have a height of H4, a fifth row of projections 70*e* have a height of H5 and a sixth row of projections 70*f* have a height of H6. The first row of projections 70*a* have the shortest height H1, the sixth row of projections 70*f* have the tallest height H6, and the intermediate rows become taller when extending from the first row of projections 70*a* to the sixth row of projections 70*f*. The projections 70 create an inclined or graduated surface, as shown in FIG. 7. In one example, each projection 70 is substantially rectangular in shape. In one example, the projections 70 are flexible. In one example, the drying mat 66 is made of a soft and flexible material, such as TPR SHORE A50 (a thermoplastic rubber having a hardness level of SHORE A50). In one example, drying mat 66 is made of rubber and/or plastic.

Figure 8:
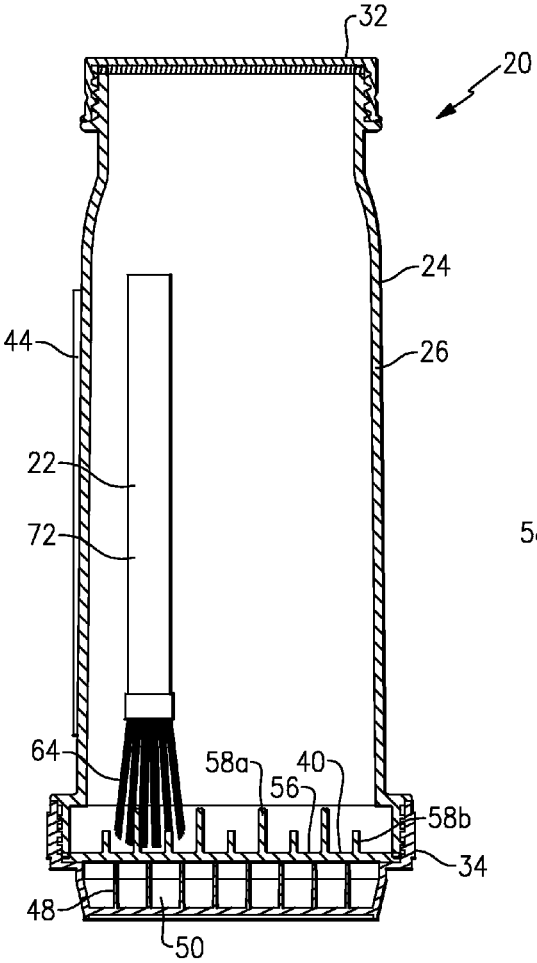
FIG. 8 illustrates a side view of the brush cleaning system including a brush.
Figure 9:
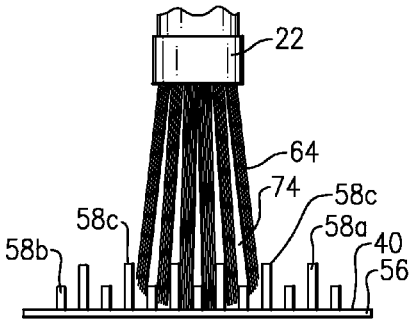
FIG. 9 illustrates an enlarged side view of bristles of the brush in the container.

When a brush 22 is to be cleaned, the upper cap 32 of the container 24 is removed, and a liquid soap is added to the container 24. In one example, the liquid soap is Dawn®, a registered trademark owned by The Procter & Gamble Company located in Cincinnati, Ohio. While the upper cap 32 is removed, warm water is added to the container 24 to the file line 54. At least one brush 22 is then then added to the container 24. Each brush 22 includes the plurality of bristles 64 and a handle 72. As shown in FIGS. 8 and 9, the bristles 64 of the brushes 22 contact the jar mat 40, and the projections 58 cause the bristles 64 to splay in a controlled manner into groups that are separated by spacings 74 and simultaneously limited in the degree of their splaying at an outer edge of the bristles 64 by projections 58*c*, preventing excess splaying and damage to the brush 22.

The upper cap 32 is then secured to the upper end 28 of the container 24, and the container 24 is shaken end to end or in the direction from the upper cap 32 to the lower cap 34. During shaking, the projections 58 engage the bristles 64 of the brush 22 and act as agitators to move the bristles 64, allowing the water and soap to flow around the individual bristles 64 to remove any make up, oil, or debris. The agitation and the physical motion caused by shaking help to loosen and break up any liquids, powders, facial oils and bacteria in the bristles. In one example, the container 24 is shaken for 1 to 2 minutes.

Multiple brushes 22 can be cleaned at once in the container 24. Once the brushes 22 are cleaned, the dirty water is poured out of the upper end 28 of the container 24. In one example, the upper cap 32 is removed to pour the dirty water from the container 24. The brushes 22 are then rinsed by adding clean water to the container 24, shaking the container 24, and pouring out residual dirty water. This rinse process is repeated until the water runs clear. The clean brushes 22 are then removed from the container 24. The cleaning of one or more brushes 22 can be completed in 5 minutes or less, allowing for clean brushes 22 that will function better when used next. The brush or brushes 22 can be cleaned efficiently without becoming messy.

Figure 10:
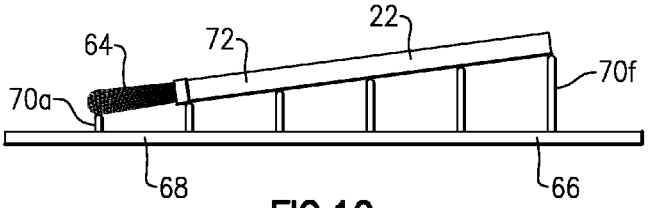
FIG. 10 illustrates a side view of the brush on the drying mat.

The bristles 64 of the brushes 22 are then patted on a clean towel and then placed on the drying mat 66, as shown in FIG. 10, such that the bristles 64 are located near the shortest projections 70*a* and the handle 72 is located near the tallest projections 70*b*, 70*c*, 70*d*, 70*e* and 70*f*. This allows any water remaining in the bristles 64 to drain away from the handle 72, assisting drying. Because the drying mat 66 also elevates the entire length of the brush 22, it allows air to circulate 360° around the bristles 64 of the brush 22, assisting drying.

Figure 11:
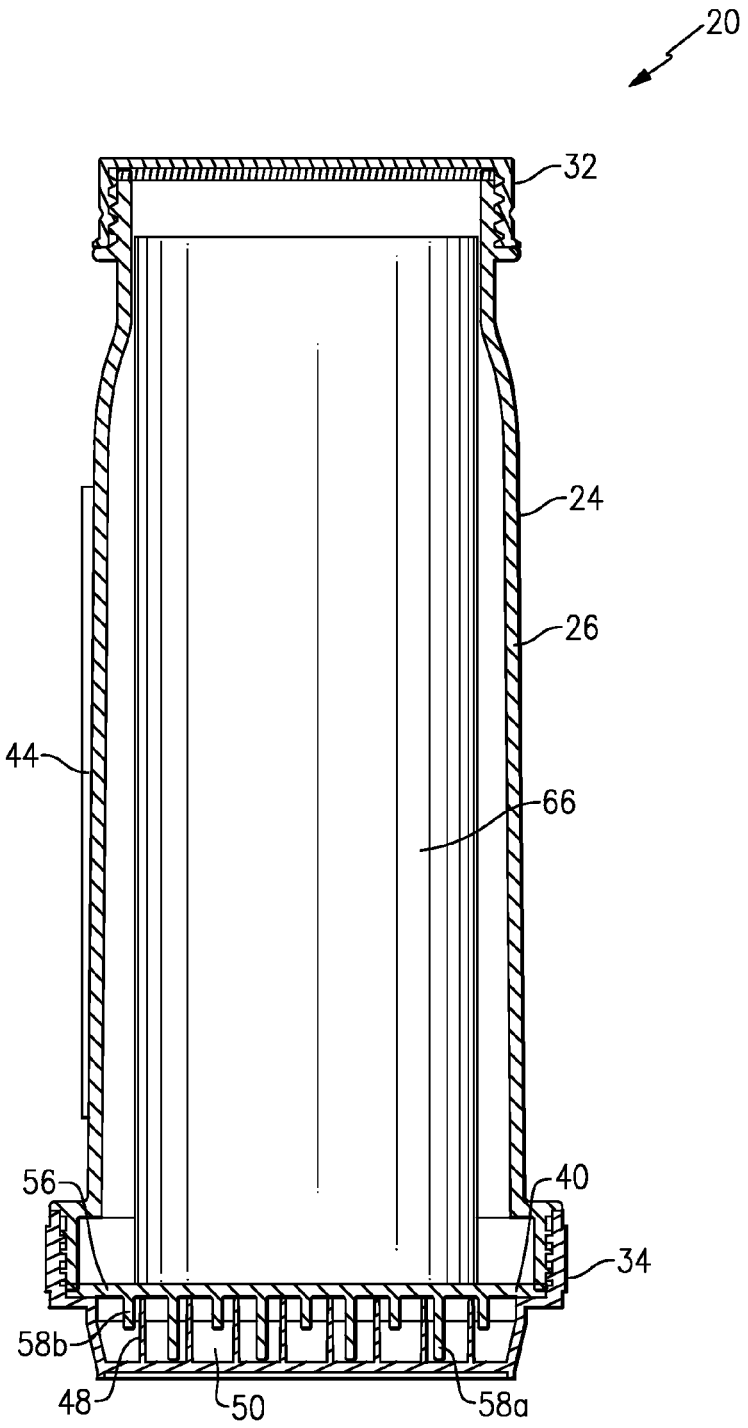
FIG. 11 illustrates a side view of the brush cleaning system in the storage position with the drying mat stored in a container.

Once the brushes 22 are dried, the drying mat 66 is rolled up as shown in FIG. 11 and placed in the container 24. The upper cap 32 can then be secured to the upper end 28 of the container 24.

In another example, the lower lid 34 can be removed from the container 24 and used to clean the brush 22. In this example, the bristles 64 of the brush 22, while wet and soapy, are swirled and/or rubbed against the jar mat 40 and the projections 58 to clean the brush 22. The lower lid 34 is held in one hand, and the brush 22 is held in the other hand during cleaning.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A brush cleaning system comprising:

a container having an interior compartment, a bottom portion, and an opening, wherein the container has a height and the bottom portion has a longest dimension, and the height is greater than the longest dimension of the bottom portion;

a plurality of projections located proximate to the bottom portion of the container, wherein the plurality of projections are located inside the interior compartment, the plurality of projections comprise a first set of projections and a second set of projections, the first set of projections are taller than the second set of projections, and bristles of a brush engage the plurality of projections to splay the bristles of the brush; and a cap that seals the opening of the container, wherein a liquid solution is added to the container to clean the brush, wherein the opening is an upper end opening and the cap is an upper end cap, and the brush cleaning system further includes a lower end opening and a lower end cap, and the lower end cap seals the lower end opening of the container.

2. The brush cleaning system as recited in claim 1 wherein the lower end cap includes an inner surface having a plurality of parallel ribs and a plurality of spaces, wherein one of the plurality of spaces is located between two adjacent of the plurality of parallel ribs.

3. The brush cleaning system as recited in claim 1 wherein the container includes a fill line to indicate a quantity of the liquid solution added to the container.

4. The brush cleaning system as recited in claim 1 including a jar mat including the plurality of projections, wherein the jar mat includes a base and the plurality of projections project upwardly from the base.

5. The brush cleaning system as recited in claim 1 wherein the bristles are splayed in a controlled manner.

6. The brush cleaning system as recited in claim 1 wherein each of the plurality of projections have a rounded tip.

7. The brush cleaning system as recited in claim 1 including a jar mat including the plurality of projections, wherein the jar mat includes a base and the plurality of projections project upwardly from the base, and the jar mat and the container are separate components such that the jar mat is removable from the container.

8. A brush cleaning system comprising:

a container having a bottom portion and an opening;

a plurality of projections located proximate to the bottom portion of the container, wherein bristles of a brush engage the plurality of projections to splay the bristles of the brush, the plurality of projections include a first set of projections and a second set of projections, the first set of projections are taller than the second set of projections, and one of the first set of projections and one of the second set of projections alternate;

a cap that seals the opening of the container, wherein a liquid solution is added to the container to clean the brush; and a jar mat including the plurality of projections, wherein the jar mat includes a base, and the plurality of projections project upwardly from the base.

9. A brush cleaning system comprising:

a container having a bottom portion and an opening;

a jar mat including the plurality of projections, wherein the jar mat includes a base and the plurality of projections project upwardly from the base;

a plurality of projections located proximate to the bottom portion of the container, wherein bristles of a brush engage the plurality of projections to splay the bristles of the brush;

a lower cap that seals the opening of the container, wherein a liquid solution is added to the container to clean the brush, wherein the lower cap includes an inner surface having a plurality of parallel ribs and a plurality of spaces, one of the plurality of spaces is located between two adjacent of the plurality of parallel ribs, the plurality of projections are located in the plurality of spaces of the lower cap when in a storage position, and the jar mat can be rotated 180° such that the plurality of projections are extending towards an upper opening of the container when in a use position.

10. A brush cleaning system comprising:

a container having a bottom portion and an opening;

a plurality of projections located proximate to the bottom portion of the container, wherein bristles of a brush engage the plurality of projections to splay the bristles of the brush;

a cap that seals the opening of the container, wherein a liquid solution is added to the container to clean the brush; and a graduated drying mat including a base and a plurality of projections extending upwardly from the base, wherein the plurality of projections have different heights to define a graduated surface, and the brush is placed on the drying mat to dry the brush.

11. A brush cleaning system comprising:

a container having an interior compartment, a lower opening, an upper opening, and a bottom portion;

a jar mat including a base and a plurality of projections that project upwardly from the base towards the upper opening, wherein the plurality of projections are located inside the interior compartment, and bristles of a brush engage the plurality of projections to splay the bristles of the brush in a controlled manner;

a lower cap that seals the lower opening of the container, wherein the lower cap includes an inner surface having a plurality of parallel ribs and a plurality of spaces, one of the plurality of spaces is located between two adjacent of the plurality of parallel ribs; and an upper cap that seals the upper opening of the container, wherein a liquid solution is added to the container to clean the brush.

12. The brush cleaning system as recited in claim 11 wherein the container includes a fill line to indicate a quantity of the liquid solution added to the container.

13. The brush cleaning system as recited in claim 11 wherein the plurality of projections include a first set of projections and a second set of projections, wherein the first set of projections are taller than the second set of projections, and the one of the first set of projections and one of the second set of projections alternate.

14. The brush cleaning system as recited in claim 11 including a graduated drying mat including a base and a plurality of projections extending upwardly from the base, wherein the plurality of projections have different heights to define a graduated surface, and the brush is placed on the drying mat to dry the brush.

15. A brush cleaning system comprising:

a container having an interior compartment, a bottom portion, and an opening, wherein the container has a height and the bottom portion has a longest dimension, and the height is greater than the longest dimension of the bottom portion;

a plurality of projections located proximate to the bottom portion of the container, wherein bristles of a brush engage the plurality of projections to splay the bristles of the brush;

a cap that seals the opening of the container, wherein a liquid solution is added to the container to clean the brush; and a jar mat including the plurality of projections, wherein the jar mat includes a base and the plurality of projections project upwardly from the base, and the jar mat and the container are separate component such that the jar mat is removable from the container.

* * * * *